United States Patent [19]

Asano et al.

[11] 4,355,615

[45] Oct. 26, 1982

[54] AIR/FUEL RATIO CONTROL DEVICE FOR AN INTERNAL COMBUSTION ENGINE

[75] Inventors: Masaharu Asano, Yokosuka; Shoji Furuhashi; Hideyuki Tamura, both of Yokohama, all of Japan

[73] Assignee: Nissan Motor Company, Limited, Yokohama, Japan

[21] Appl. No.: 145,987

[22] Filed: May 2, 1980

[30] Foreign Application Priority Data

May 4, 1979 [JP] Japan ..... 54-54061

[51] Int. Cl.[3] ..... F02B 3/08; F02B 33/00; F02B 3/00; F02D 3/04

[52] U.S. Cl. ..... 123/437; 123/440

[58] Field of Search ..... 123/440, 445, 437, 438, 123/489; 60/276, 285

[56] References Cited

U.S. PATENT DOCUMENTS

| | | | |
|---|---|---|---|
| 4,132,200 | 1/1979 | Asano et al. | 60/285 |
| 4,153,023 | 5/1979 | Asano et al. | 123/440 |
| 4,167,396 | 9/1979 | Kondo et al. | 60/285 |
| 4,167,925 | 9/1979 | Hosaka et al. | 123/440 |
| 4,170,201 | 10/1979 | Camp et al. | 60/285 |
| 4,183,335 | 1/1980 | Asano et al. | 123/440 |
| 4,186,691 | 2/1980 | Takare et al. | 60/285 |
| 4,214,563 | 7/1980 | Hosaka | 123/440 |
| 4,226,221 | 10/1980 | Asano | 123/440 |
| 4,237,829 | 12/1980 | Asano et al. | 123/440 |
| 4,252,098 | 2/1981 | Tomczak et al. | 123/445 |

*Primary Examiner*—Raymond A. Nelli

*Attorney, Agent, or Firm*—Schwartz, Jeffery, Schwaab, Mack, Blumenthal & Koch

[57] ABSTRACT

Disclosed herewith an air/fuel ratio control device for and internal combustion engine which is capable of carrying out either feedback control or open loop control. In feedback control, a signal indicating the concentration of exhaust gas components is generated and fed to a fuel supply control device. In open loop control, a fuel injection rate is determined corresponding to intake air flow rate. For switching between feedback control and open loop control, the air/fuel ratio control device is provided with a means for detecting an abnormal condition of signal, and a means operative in response to the abnormal signal to interrupt feedback control. The air/fuel ratio control device is further provided with a means for detecting stopping of the abnormal signal and for returning control operation to feedback control.

20 Claims, 7 Drawing Figures

AIR/FUEL RATIO CONTROL DEVICE FOR AN INTERNAL COMBUSTION ENGINE

BACKGROUND OF THE INVENTION

1. Field of the Invention

The present invention relates generally to a control device for controlling an air/fuel ratio for an internal combustion engine. More specifically, the present invention relates to a control device having an exhaust gas sensor for determining the concentration of oxygen in the exhaust gas and a means for detecting an inoperative condition of the exhaust gas sensor in order to interrupt or stop feedback control.

2. Description of the Prior Art

Generally, such a type of control device comprises, for carrying out feedback control, an exhaust gas sensor for detecting concentration of oxygen generated in the exhaust gas, a circuit such as a comparator for determining the difference between a given reference value and the measured concentration, and a control circuit generating a control signal to be fed back to the fuel supply control. The control device controls the air/fuel ratio by controlling the fuel supply means so as to maintain the air/fuel ratio of an air-fuel mixture at a given value for effectively operating an exhaust gas purifier. On the other hand, while starting the engine, while the vehicle is moving off from rest, and when the vehicle is accelerating, the air/fuel ratio is determined according to the intake air flow rate by open loop control.

In the air/fuel rate control device, there may be employed an oxygen sensor using zirconia (hereafter referred to as a "zirconia oxygen sensor").

The zirconia oxygen sensor generates an electric voltage representing the oxygen concentration in the exhaust gas. Generally, the voltage produced by the zirconia oxygen sensor is higher when the air/fuel mixture is richer. Although, since the zirconia oxygen sensor varies the voltage according to the sensor temperature, at relatively lower temperatures, the voltage is too low for effective and accurate measurement of the oxygen concentration. Therefore, it is necessary to determine the sensor temperature, and when the sensor temperature is lower than a given temperature, generate a signal indicative of an abnormal condition of the sensor (hereafter referred to as "abnormal signal"). In the present specification, the word "abnormal signal" is used with the above-mentioned meaning only.

In a conventional air/fuel ratio control device, there is provided a means for switching the control operation between feedback control and open loop control in response to the abnormal signal. By this means, feedback control is switched to open loop control when the sensor temperature is too low to carry out feedback control. However, since the switching means operates only to switch feedback control to open loop control, even when the sensor is warmed up sufficiently to carry out feedback control, it is impossible to automatically switch control operation from open loop control to feedback control.

The present invention is to eliminate the above-mentioned defects and disadvantages in the prior art and to provide an air/fuel ratio control device which is capable of switching control operation thereof between feedback control and open loop control.

SUMMARY OF THE INVENTION

Therefore, it is an object of the present invention to provide an air/fuel ratio control device including a means capable of effectively switching feedback control and open loop control corresponding to a sensor temperature.

Another object of the present invention is to provide an air/fuel ratio control device having a control operation switching means incorporated with a means for determing sensor temperature.

A further object of the present invention is to provide an air/fuel ratio control device having a sensor temperature determining means which sequentially measures the sensor temperature in order to generate a switching signal to operate the control operation switching means for selectively carrying out feedback control and open loop control.

To achieve the above-mentioned and other objects, there is provided an air/fuel ratio control device capable of carrying out feedback control in which a control signal indicating the concentration of exhaust gas components is generated and fed to a fuel supply control device and an open loop control in which a fuel injection rate is determined corresponding to intake air flow rate. For switching between feedback control and open loop control, the air/fuel ratio control device is provided with a means for detecting an abnormal condition of an exhaust gas sensor and generating an abnormal signal, and a means operative in response to the abnormal signal to interrupt feedback control. The air/fuel ratio control device is further provided with a means for detecting stopping of the abnormal signal and for returning control operation to feedback control.

According to the present invention, a reference value to be compared with the exhaust gas sensor output in order to determine whether the air-fuel mixture is rich or lean, is set to a minimum value when the abnormal signal is detected. Thus, when the control operation returns to feedback control, since the reference value is minimum, switching from open loop control to feed back control is performed smoothly.

In the preferred embodiment, after returning to feedback control, the reference value is gradually increased at a given rate and a given timing so that the control can be adapted smoothly to the engine condition.

BRIEF DESCRIPTION OF THE DRAWINGS

The present invention will become more fully understood from the detailed description given below, and from accompanying drawings of the preferred embodiment of the present invention, which, however, are not to be taken as limitative of the present invention in any way, but are for the purpose of explanation only.

In the drawings.

DESCRIPTION OF THE PREFERRED EMBODIMENT

Figure 1:
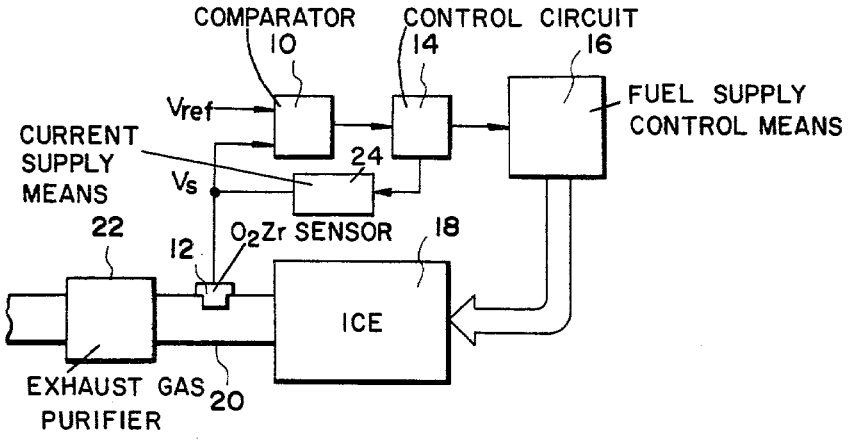
FIG. 1 is a schematic block diagram of a general construction of an air/fuel ratio control device, using an exhaust gas sensor output as one of the control parameter thereof, to which a means according to the present invention is applicable.

Referring now to the drawings, particularly to FIG. 1, an air/fuel ratio control device comprises a circuit 10 such as a comparator, for determining the difference between a reference value $V_{REF}$ which is contained in a reference signal $V_{REF}$ generated and fed to the circuit 10 in a well-know manner and an exhaust gas sensor signal Vs generated in an exhaust gas sensor 12 and fed thereto, and a control circuit 14 generating a control signal corresponding to the output of the comparator 10 indicative of the difference. The control signal is fed to a fuel supply control means 16, such as a fuel injector, carburetor and so on in order to control the fuel amount supplied to an engine 18. The control signal from control circuit 14 also controls the current supply means which supplies current to the exhaust gas sensor 12. It will be understood by one of skill in the art that the control circuit 14 may advantageously include a central processing unit (CPU) to control the current supply means.

The exhaust gas sensor 12 is provided in an exhaust pipe 20 connecting the engine 18 to an exhaust gas purifier 22. Generally, the exhaust gas sensor 12 measures the concentration of oxygen in the exhaust gas. For this purpose, a zirconia oxygen sensor is usually employed as the exhaust gas sensor 12. The sensor 12 determines oxygen concentration in the exhaust gas and generates the sensor signal $V_s$ corresponding to the measured oxygen concentration. The reference signal $V_{REF}$ to be compared with the sensor signal, has a given value corresponding to a desired air/fuel ratio of the air-fuel mixture supplied to the engine. The comparator 10 determines the difference between the reference signal $V_{REF}$ and the measured oxygen concentration of the sensor signal $V_s$, and thereby determines whether the air-fuel mixture is rich or lean.

Figure 2:
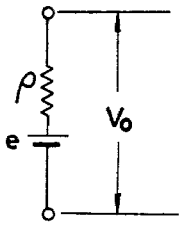
FIG. 2 is a circuit diagram of an equivalent circuit of a zirconia oxygen sensor used as the exhaust gas sensor in the air/fuel ratio control device of FIG. 1.
Figure 3:
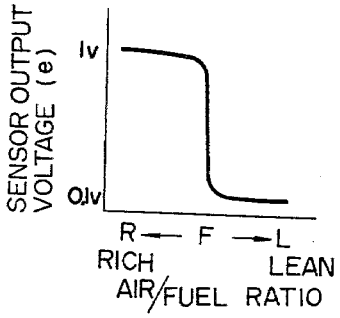
FIG. 3 is a graph showing variation of voltage output of the zirconia oxygen sensor of FIG. 2 corresponding to the air/fuel ratio.
Figure 4:
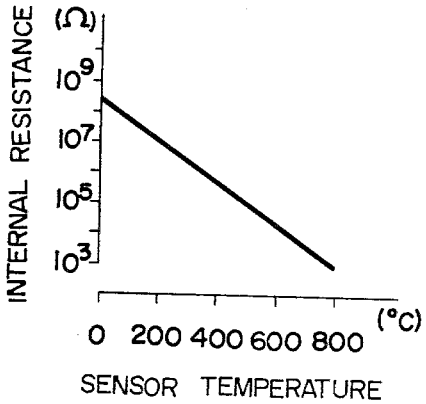
FIG. 4 is a graph showing the relationship between the internal resistance and the temperature of the zirconia oxygen sensor.

FIG. 2 shows an equivalent electrical circuit of the zirconia oxygen sensor 12, which includes a battery producing a variable voltage e corresponding to the oxygen concentration, and an internal resistance value $\rho$ varying according to the sensor temperature. As shown in FIG. 4, the resistance value $\rho$ is substantially inversely proportional to the logarithm of the sensor temperature. When the sensor temperature is in the normal range, the voltage e of the battery varies as shown in FIG. 3. When the air/fuel mixture is rich, the voltage e is about 1 V, and when the mixture is lean, the voltage e is about 0.1 V. However, if the sensor temperature is substantially low, the internal resistance $\rho$ is extremely high, and the sensor cannot deliver sufficient current to drive the control circuit reliably.

Therefore, in the air/fuel ratio control device, there is provided a means for sensing the sensor temperature. The sensor temperature sensing means determines whether the sensor temperature permits carrying out feedback control. In a typical method for determining the sensor temperature, a steady electric current i is supplied to the sensor 12 from an external power supply means. When the steady electric current is supplied, the output voltage $V_0$ of the sensor 12 is calculated by the following equation;

$$V_0 = e + \rho i$$

Figure 5:
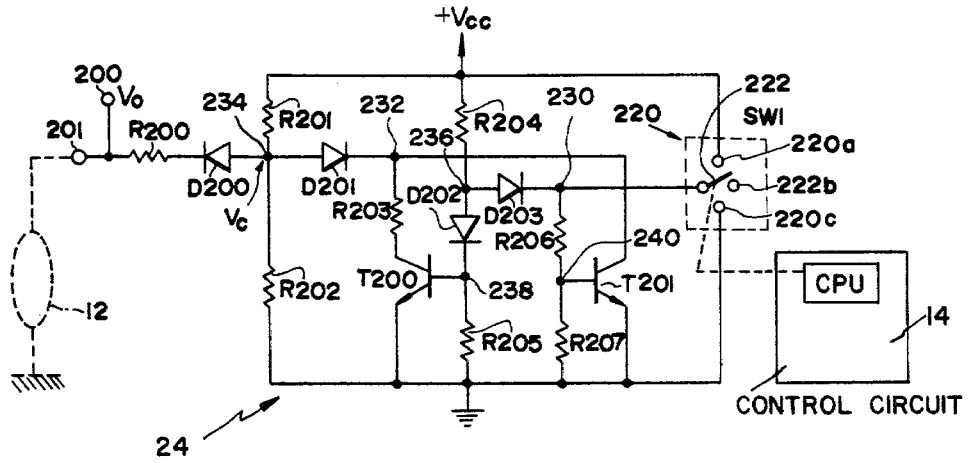
FIG. 5 is a circuit diagram of an electric power supply circuit according to the preferred embodiment of the present invention for supplying electric power to the zirconia oxygen sensor to determine an abnormal condition thereof.

From this equation, the output voltage $V_0$ is linearly dependent on the value $\rho$ of the internal resistance. Namely, if the sensor temperature is increased to reduce the resistance value $\rho$, the output voltage $V_0$ is reduced accordingly. Thus, by detecting whether the output voltage $V_0$ is within or outside a normal range which is defined between given minimum and maximum voltages, whether the sensor temperature permits carrying out feedback control is determined. FIG. 5 shows a preferred embodiment of a means for supplying a steady current to the sensor.

In FIG. 5, the numeral 24 generally denotes the current supply means and the reference numeral 220 denotes a switching means having a switching element 222 and three terminals 220*a*, 220*b* and 220*c*. The switching element 222 is selectively connected in accordance with the output of the control circuit 14 to the terminals 220*a*, 220*b*, and 220*c* so that it can vary the current flowing through a terminal 201 and thereby adjust the current supplied to the exhaust gas sensor 12 connected to the terminal 201. The switching is performed in a conventional manner, i.e. mechanically, magnetically or electrically and forms no part of the present invention.

If the switching element 222 is set to contact 220*a*, since the potential at point 230 increases to $+V_{cc}$, a transistor T201 is turned on. On the other hand, since the potential at point 232 drops to approximately zero, substantially no current flows through transistor T200. Thus, the voltage $V_c$ at point 234 is approximately zero, and thus the current flowing through the sensor 12 and the voltage $V_o$ $(=i\times\rho)$ both become minimum as shown by curve A of FIG. 6. When the switching element 222 is set to contact 220*b*, namely the switching element 222 is positioned at neutral, the potentials at point 230 and point 236 become substantially the same. The values of resistor R206 and R207 are chosen so that when the potential at point 230 is not higher than the potential at point 236, and thus is almost the same, being determined by the potential drop across diode D203, the potential at point 240 is substantially lower than that at point 238. Therefore transistor T200 will conduct, but transistor T201 will be cut off. Therefore, the potential $V_c$ at the point 234 is obtained by the following equation:

$$V_c = V_{cc} \times [R_a/(\mathrm{R201} + R_a)]$$

where $R_a$ is the combined resistance of R202 and R203 in parallel, given by $1/R_a = 1/\mathrm{R202} + 1/\mathrm{R203}$.

Here, the value of resistor R203 is determined so that the potential $V_c$ this time is slightly larger than in the previous case, i.e. when the switching element is set to contact the terminal 220*a*. Therefore, a current shown by curve B in FIG. 6 flowing through the sensor 12 is slightly higher than that when the switching element 222 contacts to the terminal 220*a*. When the switching element 222 is set to contact to the terminal 220*c*, since potentials at both of points 238 and 240 become zero, both of the transistors T200 and T201 are cut off. Therefore, the potential $V_c$ at the point 234 is obtained from the following equation:

$$V_c = V_{cc} \times [R202/(R201+R202)]$$

Figure 6:
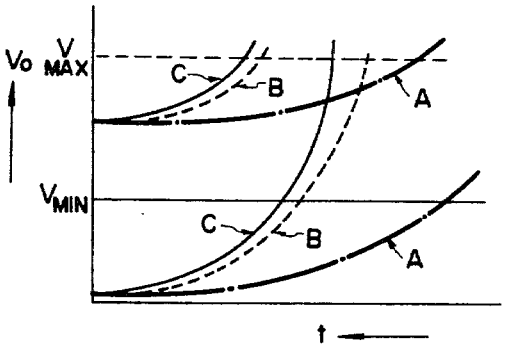
FIG. 6 is a graph showing temperature characteristics of electric voltage of circuit of FIG. 5.

Thus, at this time, the potential $V_c$ at the point 234 is the largest, and therefore the current, shown by curve C in FIG. 6, flowing through the sensor 12 is the highest among the above-mentioned three switch positions.

Thus, the current values A, B and C corresponding to the circuits formed by connecting the switching element 222 to the terminals 220*a*, 220*b*, and 220*c* respectively have the relationship: A<B<C.

Here, the current value B is slightly smaller than that of C and the current value A is considerably smaller than that of B. As shown schematically in FIG. 5, switching means 220 is incorporated into a computer (CPU). Corresponding to the control signal generated by control circuit 14 and fed to the switching means 220, the switching element 222 is caused to move in a conventional manner between the switching terminals 220*a*, 220*b* and 220*c*. Therefore, to an output terminal 201 of the circuit is supplied different electric current values depending on the switch position. As stated above, when the switching element 222 is connected to terminal 220*a*, electric current of value A flows through terminal 201. Likewise, when the switching element 222 is connected to terminal 220*b*, electric current of value B flows through terminal 201 and is supplied to the exhaust gas sensor 12. When the terminal 220*c* is connected to switching element 222, current of value C is supplied to the exhaust gas sensor 12. In FIG. 6 are illustrated variations of output voltage at an output terminal 200 outputted from the sensor 12 corresponding to current values supplied to the sensor. Generally, as shown in FIG. 3, the sensor output voltage frequently varies between 1 V and 0.1 V. Therefore, when electric current is supplied to the sensor, corresponding to increasing of sensor temperature and, thereby, reducing resistance value of the internal resistance of the sensor, the output voltage $V_o$ of the terminal 200 is gradually reduced, as shown in FIG. 6. It should be understood that in FIG. 6 the two curves shown labelled as A represent the two substantially constant values of $V_0$ corresponding to the sensor output voltages of approximately 0.1 V and 1 V on the lean and rich mixture sides, respectively. Thus in the course of feedback control, when for example the switching element 222 is connected to terminal 220*a* and, thereby, value A of electric current is supplied to the sensor, the sensor output voltage $V_o$ varies between the curves A—A. As will be seen in FIG. 6, when the sensor is sufficiently warmed up, the lower value of the electric voltage $V_o$ is less than a given minimum value $V_{min}$. However, if the sensor operates under normal conditions, the period of time that the electric voltage is lower than the minimum $V_{min}$, is short enough to be disregarded, i.e. 0.1 or 0.2 sec. If the sensor output voltage $V_o$ stays below $V_{MIN}$ for a substantial period of time, this means that the sensor circuit is damaged.

When attempting to discriminate whether the sensor 12 is sufficiently warmed up, the switching element 222 is connected to terminal 220*c* to supply the largest current C to the sensor. At this time, the sensor output voltage $V_o$ varies between the curves C—C of FIG. 6. The output voltage $V_o$ is continuously compared with a given maximum value $V_{max}$. When the output voltage becomes less than the maximum, the sensor will be determined to be sufficiently warmed up.

When immediately after discrimination that the sensor is sufficiently warmed up, the switching element 222 is connected with the terminal 220*b* for a relatively short period of time. While the current value B is supplied to the sensor 12, the output voltage $V_o$ varies frequently between the curves B—B of FIG. 6.

Figure 7:
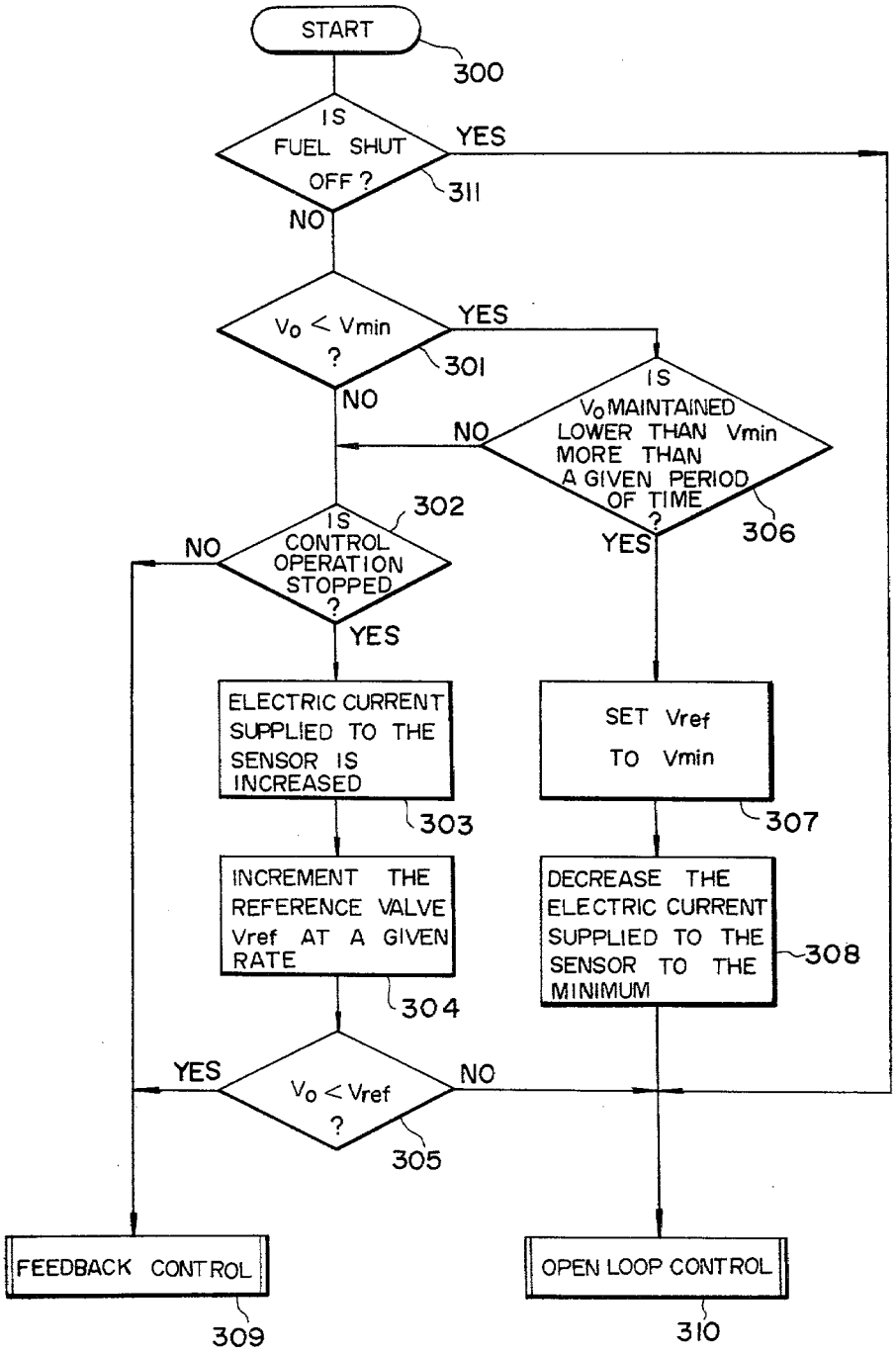
FIG. 7 is a flowchart of an operation of the air/fuel ratio control device according to the present invention.

In FIG. 7 is illustrated a flowchart for detecting an abnormal sensor temperature to switch control operation from feedback control to open loop control and for returning from open loop control to feedback control. The program is executed repeatedly at given intervals. First, decision block 311 checks whether fuel supply is shut off. If the decision of the block 311 is YES, control immediately skips to a block 310 in which open loop control is carried out. When the decision of the block 311 is NO, then the sensor output voltage $V_0$ is compared with a minimum reference voltage $V_{min}$ in a decision block 301. Thus fuel shut off is one criteria for determining whether to switch to open or closed loop operation. Detecting fuel shut off may be done by any conventional method, for instance by the device described in German Offenlegungsschrift No. 26 15 504. If the output voltage $V_0$ is higher that that of Vmin, and therefore, the decision of the block 301 is NO, then decision block 302 checks whether control operation is stopped. If the decision of the block 302 is NO, feedback control is carried out immediately. If the decision of the block 302 is YES, then the electric current supplied to the sensor from the external power supply means such as shown in FIG. 5, is increased in block 303. Thereafter the reference value $V_{REF}$ of the reference signal $V_{REF}$ is incremented at a given rate, in block 304. This incrementation of the reference voltage $V_{REF}$ may be done by incrementating the voltage by a predetermined amount for a given amount of engine revolution as. This can be accomplished in any conventional manner, for instance in the manner suggested by Hosaka et al in U.S. Pat. No. 4,167,925. Alternatively the incrementation may be accomplished by simply increasing the reference voltage $V_{REF}$ at a fixed rate in real time. The rate for incrementation of the reference value $V_{REF}$ is previously determined so that, within a normal temperature of the sensor, the reference value $V_{REF}$ is larger than the output voltage $V_0$ of the sensor. For discriminating whether the sensor temperature is in the normal range, the output voltage $V_0$ of the sensor is compared with the reference value $V_{REF}$ in a decision block 305. When the decision of the block 305 is YES, then feedback control is carried out.

If the output voltage $V_0$ is lower than that of $V_{min}$, and thereby, the decision of the block 301 is YES, whether decision block 306 checks the output voltage $V_0$ is maintained lower than that of $V_{min}$ more than a given period of time. If the decision of the block 306 is YES, the reference value $V_{REF}$ is set to the minimum $V_{min}$ in block 307. Then the electric current supplied to the sensor is decreased to the minimum value. Thereafter, open loop control is carried out. When the decision of the block 306 is NO, then control skips to block 302 to check whether control operation is stopped.

According to the above-mentioned program, by checking whether the fuel supply is shut off at the beginning of execution of the program, it is possible to distinguish the case when the sensor is not functioning properly. If block 311 were omitted, then if the fuel is shut off for an appreciable period of time, this would be interpreted as a malfunction, and the return to feedback control would be delayed. Thus, by providing the block 311, it is possible to respond to restarting of fuel supply and to smoothly switch between feedback control and open loop control.

Further, in the preferred embodiment of the present invention, when the abnormal temperature condition of the sensor is detected and thereby open loop control is carried out, the reference value $V_{REF}$ is set at minimum $V_{min}$ at the block 307. Thus, when the sensor temperature enters into the normal range, switching of the control operation from open loop control to feedback control can be performed smoothly. At this time, the reference value $V_{REF}$ is minimum. After starting feedback control, the reference value $V_{REF}$ is gradually increased until it reaches a given maximum value $V_{max}$ at a given rate and a given timing. In practice, the incrementation of the reference value $V_{REF}$ is performed at a timing corresponding to the given cycle of engine revolution or a given period defined by clock pulse.

Thus, the present invention fulfills all of the objects and advantages sought.

What is claimed is:

1. An air/fuel control device for an internal combustion engine having a fuel supply comprising:

an exhaust gas sensor provided in an exhaust gas passage of said internal combustion engine for determining an exhaust gas component concentration and for generating a sensor signal indicative of the determined concentration;

a discriminating circuit for comparing said sensor signal value with a first reference value and determining if said exhaust gas sensor temperature condition satisfies a feedback control condition, said discriminating circuit producing a switching signal when said feedback control condition is satisfied;

a control circuit, responsive to said switching signal, for effecting feedback control operation and open loop control operation selectively, said control circuit feedback controlling said fuel supply and producing a control signal indicative of a determined fuel rate, said control circuit resetting said first reference value to a minimum value when control operation mode is switched from feedback control to open loop control; and an electric power supply control circuit for controlling an electric current supplied to said exhaust gas sensor, said power supply control circuit including a switching means for adjusting the electric current value, said switching means having first means for comparing said sensor signal value with a minimum value for determining the sensor condition, second means for measuring a period of time during which said first means determines said sensor signal value is lower than said minimum value and a third means for supplying a minimum value of electric current when said second means determining said sensor is not in a condition to effect feedback control.

2. A method for controlling the air/fuel ratio in an internal combustion engine having an air/fuel ratio control system and having fuel supply means for controlling the air/fuel ratio, said system including an exhaust gas sensor for determining the concentration of an exhaust gas component and generating an exhaust gas sensor signal corresponding to the sensed exhaust gas component concentration, said system being operable to control the air/fuel ratio by feedback control or by open loop control and having means for switching control operation between feedback control and open loop control corresponding to a condition of said sensor, the method comprising supplying an electric current to said exhaust gas sensor;

changing said current value between predetermined maximum and minimum values;

generating a sensor signal indicative of the sensed exhaust gas component concentration while applying said electric current to said sensor;

comparing said sensor signal value with reference values, said reference values defining maximum and minimum values respectively to determine if the sensor is in a condition to carry out feedback control;

controlling said fuel supply means by feedback control;

measuring the period of time during which said sensor signal value remains below said minimum value;

switching control operation from feedback control to open loop control when said measured period of time is longer than a predetermined period; and resetting the value of said reference values to be compared with said sensor signal value to the minimum value thereof and setting said electric current to be supplied to the exhaust gas sensor to the minimum value thereof when switching control operation from feedback control to open loop control.

3. A feedback control system for an internal combustion engine, said control system operable as a feedback system or an open loop system comprising:

fuel supply means for supplying fuel to the engine at a controlled rate, said fuel being supplied as a gas mixture having an air/fuel ratio;

an exhaust system including an exhaust passage having an oxygen sensor for determining oxygen concentration in the exhaust gas and for producing a sensor signal indicative of the determined oxygen concentration;

a power circuit for supplying an electric current to said oxygen sensor, said power circuit varying the electric current value to be supplied to the oxygen sensor depending upon the sensor temperature;

control means for comparing said sensor signal value with a first reference value to discriminate whether the sensor temperature condition satisfies a feedback condition and for feedback controlling said fuel supply means based on a difference between said sensor signal value and a second reference value representative of a desired air/fuel ratio while said feedback condition is satisfied, said control means including means for incrementing said second reference value at a given rate and a given timing and for setting said second reference value at a minimum value when control operation is switched from feedback control to open loop control, said control means varying the current value supplied to the oxygen sensor to a predetermined minimum value during open loop operation.

4. A feedback control system for an internal combustion engine for controlling air/fuel ratio of a mixture to be supplied thereto, comprising:

fuel supply means for supplying fuel to the engine at a controlled rate;

an exhaust system including an exhaust passage having an oxygen sensor for determining an oxygen concentration in the exhaust gas and producing a sensor signal value indicative of said oxygen concentration;

a power circuit for supplying an electric current to said oxygen sensor, said power circuit varying the current value depending on the oxygen sensor temperature condition within a predetermined range;

discrimination means for discriminating if said mixture is rich or lean based on said sensor signal value, said discrimination means comprising said sensor signal value with a second reference value representative of a desired air/fuel ratio;

control means for feedback controlling said fuel supply means based on the difference between said second reference value and said sensor signal value, said control means having means for incrementing said second reference value at a given rate and a given timing during feedback control, said control means further comprising said sensor signal value with a first reference value indicative of the minimum value for feedback control operation and having means for switching control operation from feedback control to open loop control when the sensor signal value is smaller than said first reference value and setting said second reference value to a predetermined minimum value and said current value to be supplied to the sensor by said power circuit to a minimum value in said predetermined range.

5. A method for controlling air/fuel ratio in a mixture supplied to an internal combustion engine having a fuel supply comprising:

measuring an oxygen concentration in an exhaust gas and producing a sensor signal indicative of the measured oxygen concentration;

comparing said sensor signal value with a second reference value representative of a desired air/fuel ratio and obtaining any difference therebetween;

determining fuel supply to the engine based on said difference between the measured sensor signal value and said second reference value and feedback controlling said fuel supply so that the air/fuel ratio supplied to said engine approaches said desired value;

supplying electric current to said oxygen sensor, varying said electric current to the sensor depending on the sensor temperature condition;

comparing said sensor signal value with a first reference value representative of the minimum value of the sensor signal for feedback control operation;

measuring a period of time during which the sensor signal value remains below said first reference value;

switching operational control of said fuel supply from feedback control to open loop control when the measured period exceeds a predetermined period;

setting said second reference value to a predetermined minimum value and said electric current to the sensor to a predetermined minimum value during open loop operation; and returning the operational control from open loop to feedback control when the sensor signal value becomes larger than the minimum first reference value.

6. A device as set forth in claim 1, wherein said exhaust gas sensor is a zirconia oxygen sensor having an internal resistance depending on sensor temperature.

7. A device as set forth in claim 1, wherein said switching means further includes means for detecting said sensor signal value and generating a switching signal when said signal value voltage exceeds said minimum value and a means for increasing the electric current supplied to said sensor in response to said switching signal.

8. A device as set forth in claim 1, wherein said control circuit includes a means for returning control operation from open loop control to feedback control if said sensor signal value exceeds said minimum value during open loop control operation.

9. A device as set forth in claim 1, wherein said reference voltage is increased by a given amount for a given amount of engine revolution.

10. A device as set forth in claim 1, wherein said reference voltage is increased at a fixed rate in read time.

11. A device as set forth in claim 1, wherein said timer means becomes inoperative under fuel shut off condition of fuel supply means.

12. A method as set forth in claim 2, wherein said reference value is set at said maximum value during feedback control operation.

13. A method as set forth in claim 12, wherein said reference value is gradually increased from said minimum value to said maximum value at a predetermined rate and a predetermined timing.

14. A method as set forth in claim 13, wherein said predetermined timing is determined as a function of engine revolution.

15. A method as set forth in claim 13, wherein said predetermined timing is defined by a clock timer.

16. A method as set forth in claim 2, including the step of interrupting said feedback control under a fuel cut off condition of said fuel supply means.

17. A system as set forth in claim 3 or 4, wherein said control means includes means for measuring a period of time during which said sensor signal value remains less than said first reference value and for comparing said period with a predetermined period of time, wherein said control means switches control operation from feedback control to open loop control when the measured period exceeds said predetermined period.

18. A system as set forth in claim 17, wherein said power circuit includes a switch means for selectively changing between a first position supplying maximum value of current to said sensor, and a second position supplying minimum value of current and a third position disconnecting the sensor from a power source, said switch means being shifted to said second position in response to said control means switching the control operation from feedback control to open loop control.

19. A method as set forth in claim 5, wherein said second reference value is incremented at a predetermined timing and a predetermined rate during feedback control operation.

20. A method as set forth in claim 5 or claim 19, wherein feedback control is disabled when the fuel supply is a state of cut-off.

* * * * *